US008269150B2

(12) United States Patent
Kim et al.

(10) Patent No.: US 8,269,150 B2
(45) Date of Patent: Sep. 18, 2012

(54) ELECTRIC HEATER

(75) Inventors: Je-Hoon Kim, Seoul (KR); Hyoung-Jun Kim, Seoul (KR); Byeong-Wook Park, Seoul (KR)

(73) Assignee: LG Electronics Inc., Seoul (KR)

( * ) Notice: Subject to any disclaimer, the term of this patent is extended or adjusted under 35 U.S.C. 154(b) by 411 days.

(21) Appl. No.: 12/669,622

(22) PCT Filed: Jul. 14, 2008

(86) PCT No.: PCT/KR2008/004121

§ 371 (c)(1),
(2), (4) Date: Jan. 19, 2010

(87) PCT Pub. No.: WO2009/014333

PCT Pub. Date: Jan. 29, 2009

(65) Prior Publication Data

US 2010/0193502 A1 Aug. 5, 2010

(30) Foreign Application Priority Data

Jul. 20, 2007 (KR) ..... 10-2007-0073022
Jul. 20, 2007 (KR) ..... 10-2007-0073024

(51) Int. Cl.
*H05B 3/06* (2006.01)

(52) U.S. Cl. ..... 219/482; 219/443.1; 219/504; 219/520

(58) Field of Classification Search ..... 219/443.1, 219/466.1, 504; 338/306, 307, 310, 311, 338/312, 313, 314
See application file for complete search history.

(56) References Cited

U.S. PATENT DOCUMENTS

| | | | | |
|---|---|---|---|---|
| 4,002,883 | A | 1/1977 | Hurko | 219/543 |
| 6,392,205 | B1 * | 5/2002 | Minonishi | 219/443.1 |
| 6,616,767 | B2 * | 9/2003 | Zhao et al. | 219/121.52 |
| 6,720,533 | B2 * | 4/2004 | Keum et al. | 219/462.1 |
| 6,875,960 | B2 * | 4/2005 | Yamaguchi et al. | 219/462.1 |

FOREIGN PATENT DOCUMENTS

| | | |
|---|---|---|
| GB | 860213 A | 2/1961 |
| JP | 04-337276 | 11/1992 |
| JP | 10-213981 | 8/1998 |
| JP | 2006-108011 | 4/2006 |
| WO | WO 96/17496 A1 | 6/1996 |

OTHER PUBLICATIONS

International Search Report dated Nov. 29, 2008.
European Search Report dated Apr. 5, 2012 issued in Application No. 0 877 8779.

* cited by examiner

*Primary Examiner* — Tan T. Nguyen
(74) *Attorney, Agent, or Firm* — KED & Associates, LLP

(57) ABSTRACT

Disclosed is the electric heater including a base, and a heating unit having a plurality of unit heating elements disposed on a plate surface of the base and at least one of heating connection portions configured to heat and conductively connecting the unit heating elements to each other and non-heating connection portions configured not to heat and conductively connecting the unit heating elements to each other, thereby preventing a thermal stress concentration, thus to prevent damage to the heating unit and to enhance its output.

19 Claims, 10 Drawing Sheets

[Fig. 1]
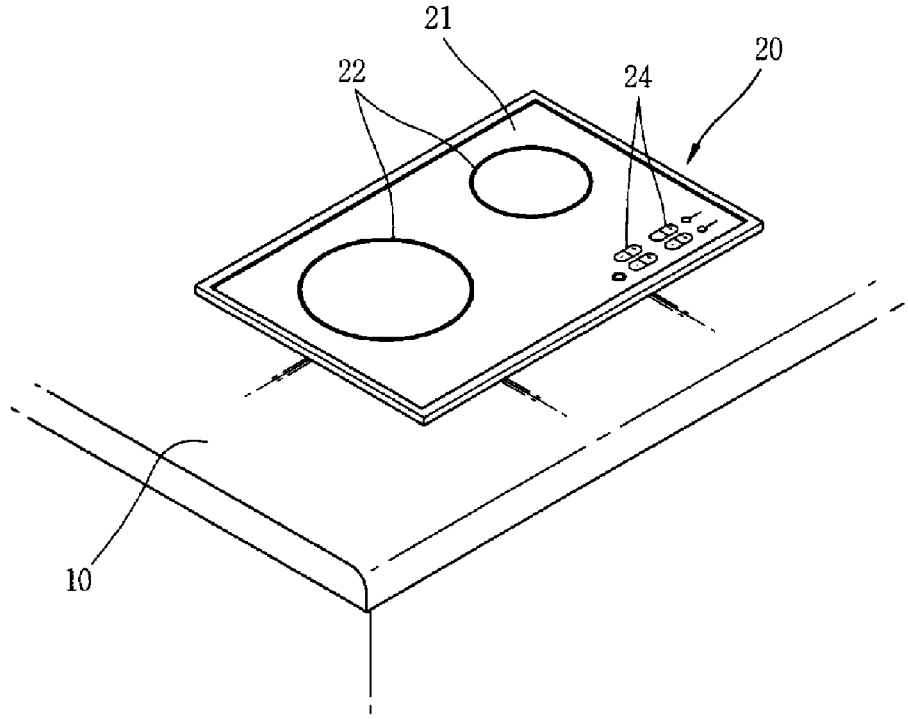
[Fig. 2]
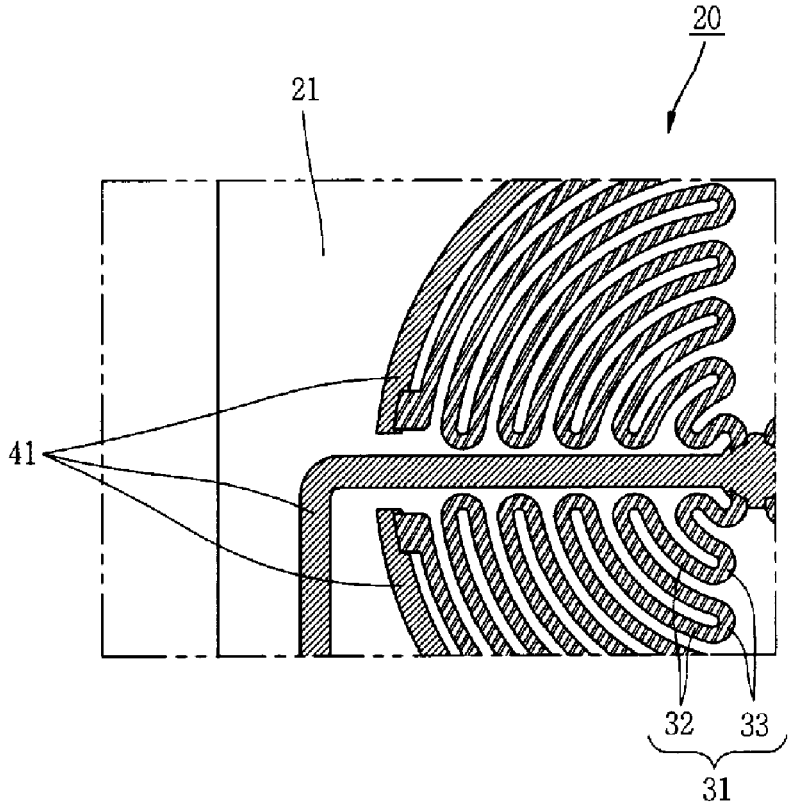

[Fig. 3]
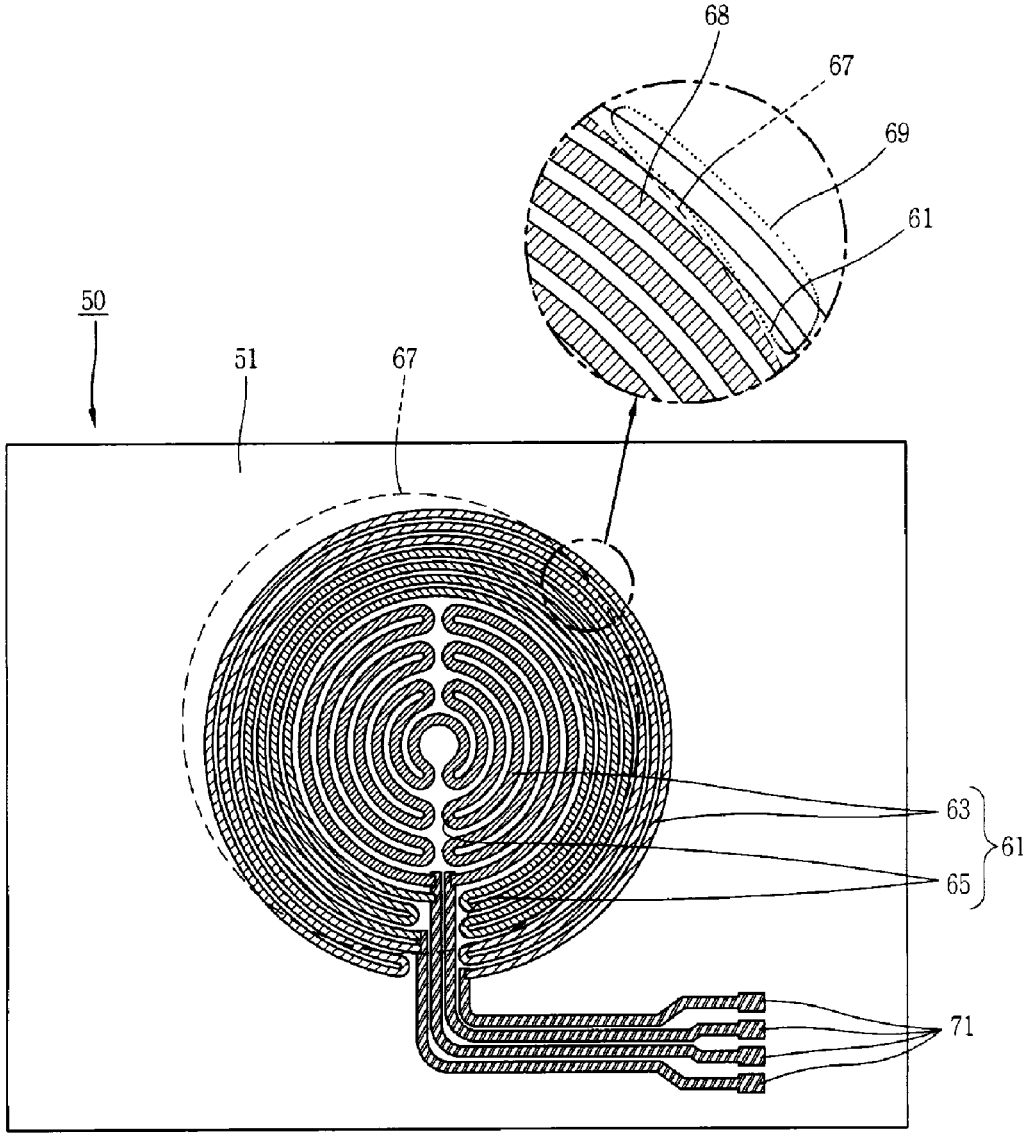

[Fig. 4]
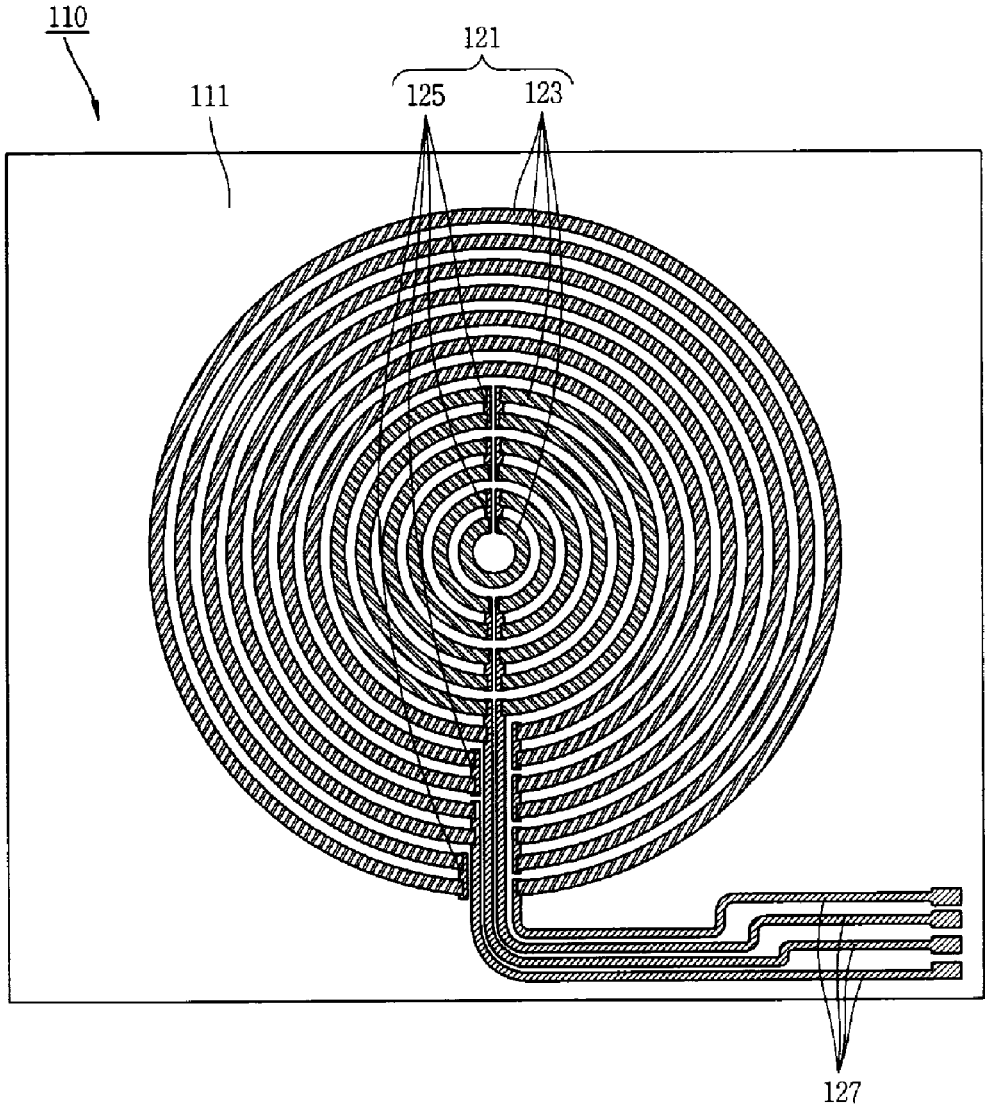

[Fig. 5]
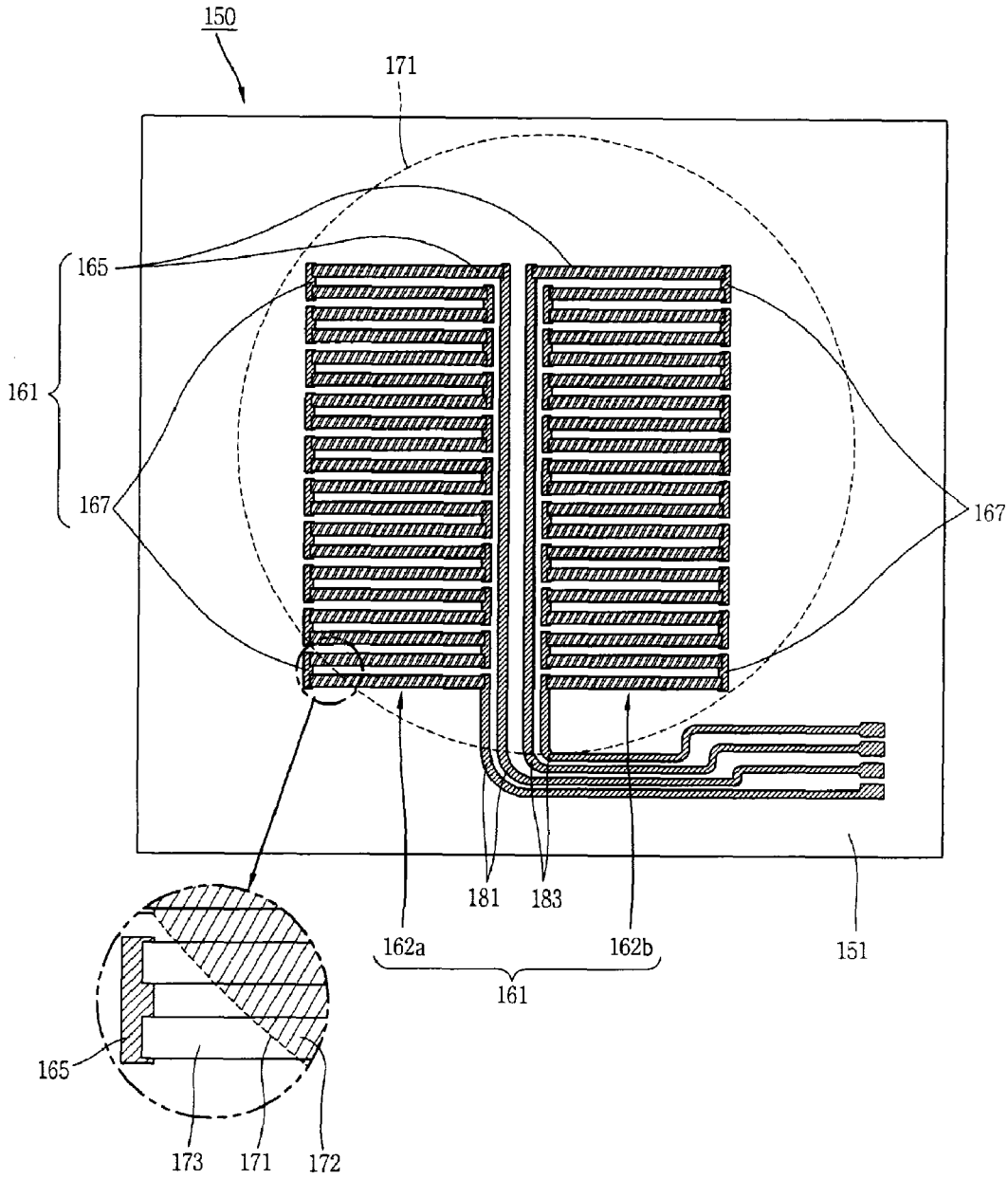

[Fig. 6]
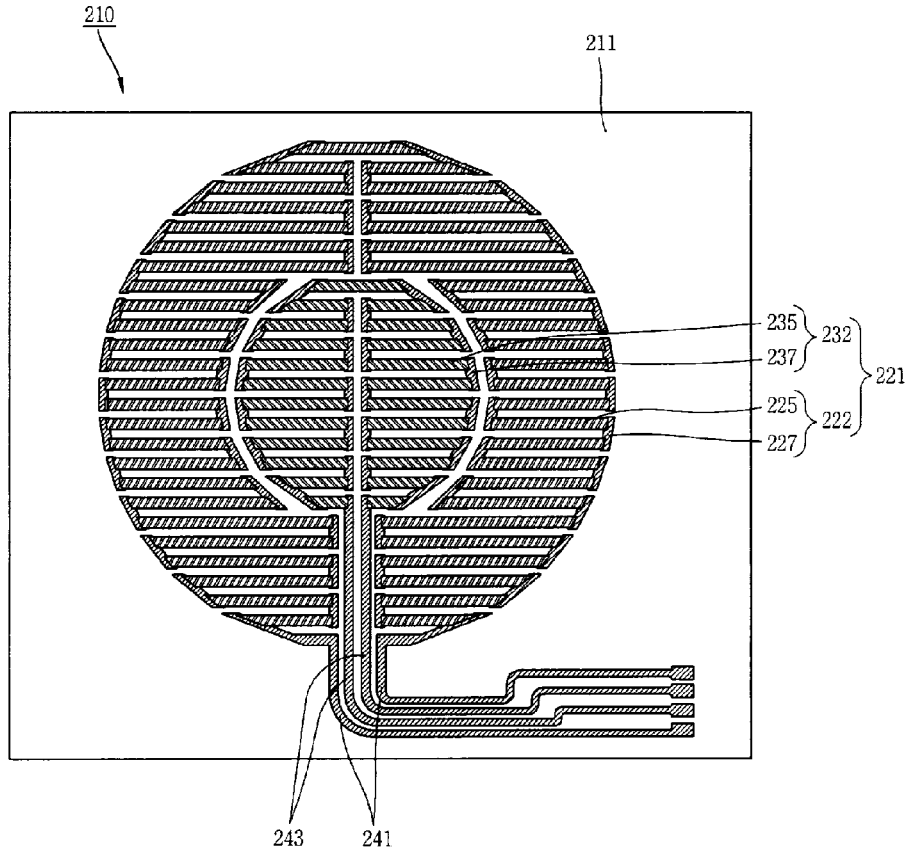
[Fig. 7]
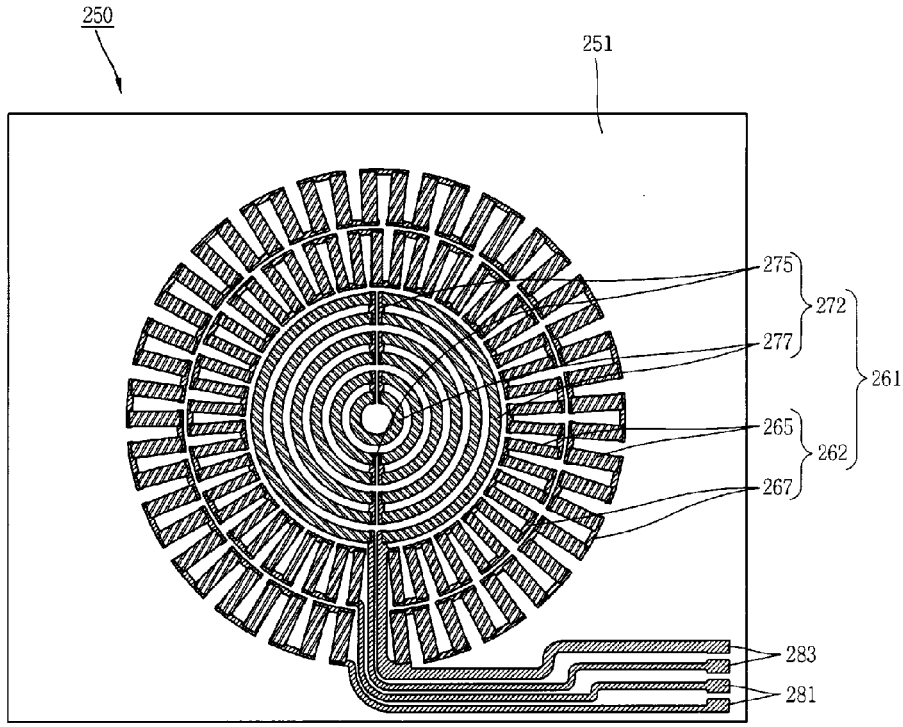

[Fig. 8]
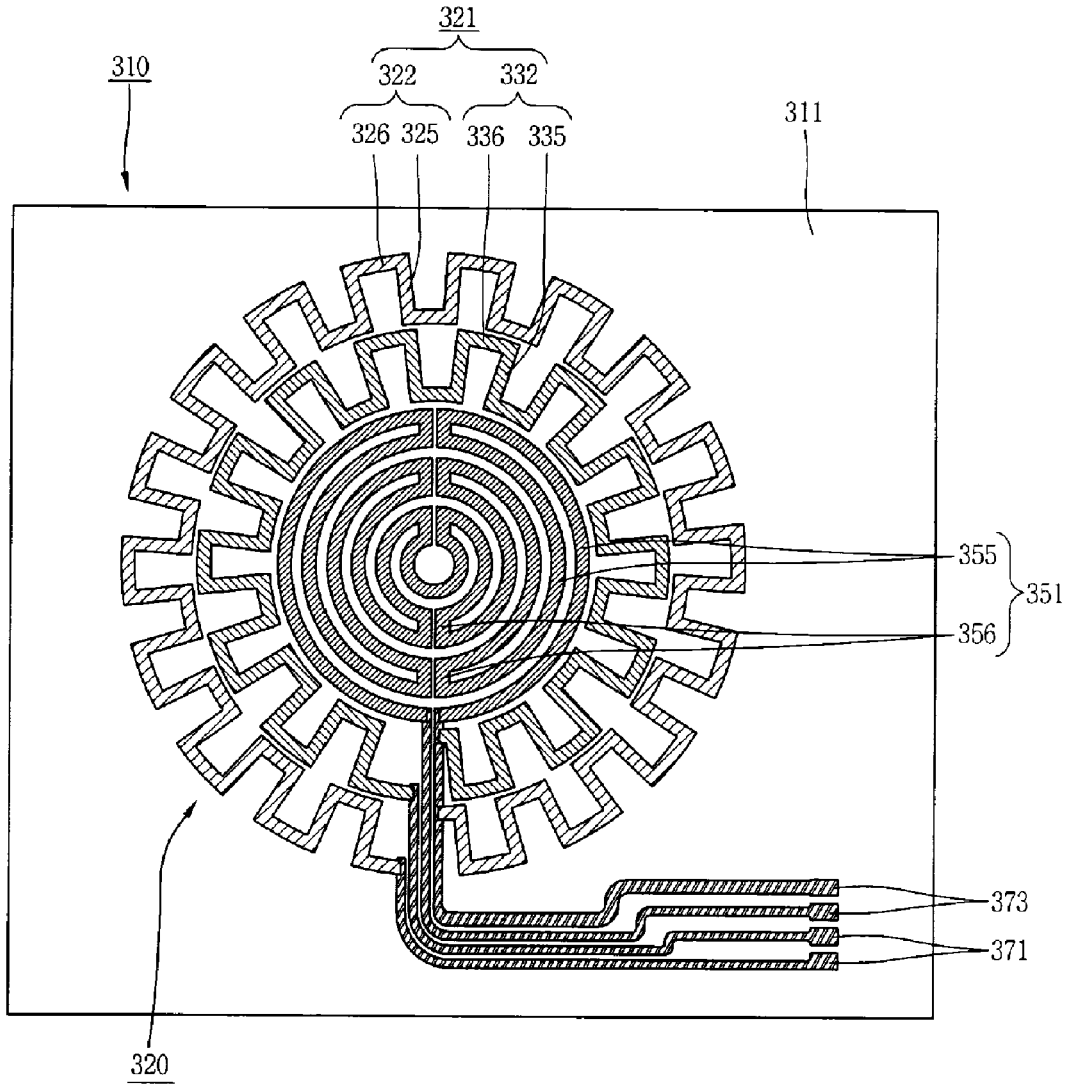

[Fig. 9]
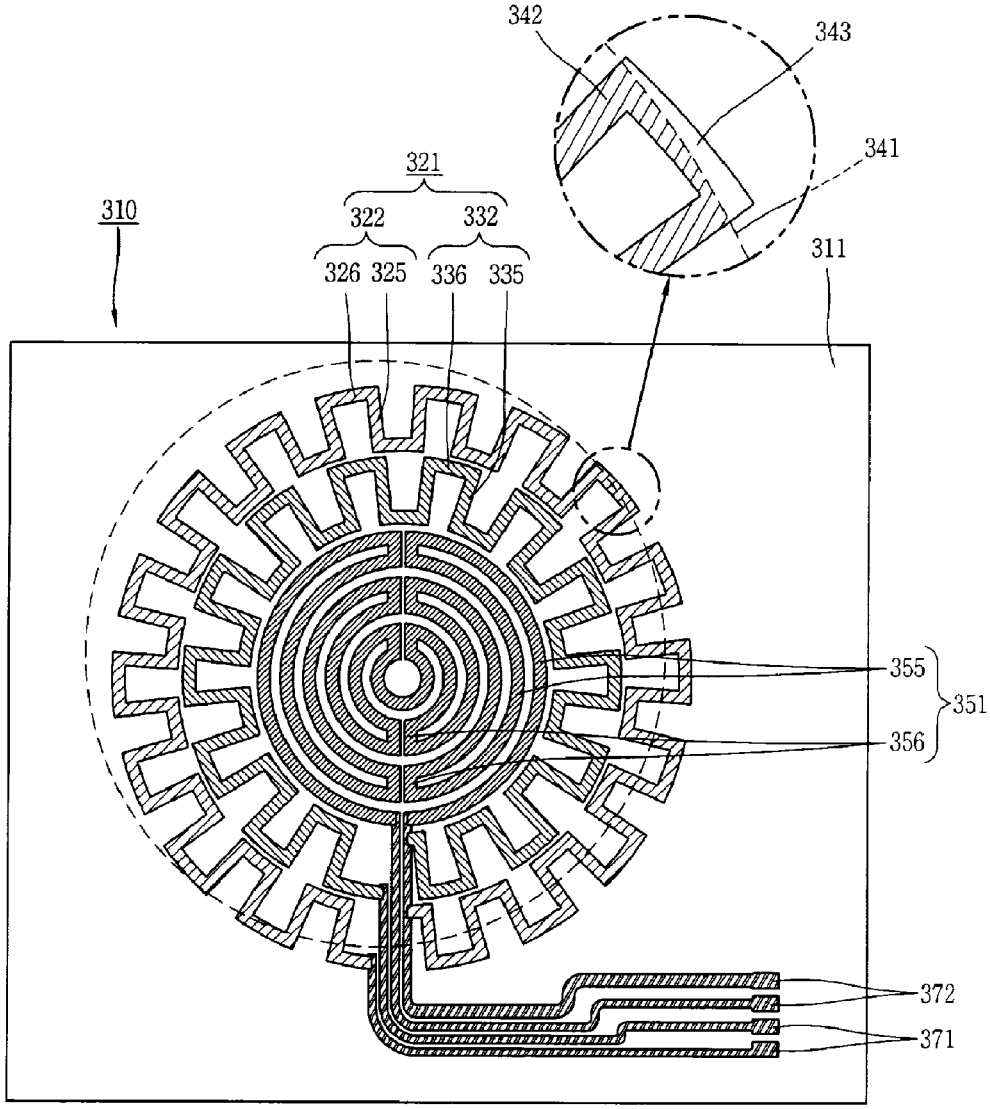

[Fig. 10]
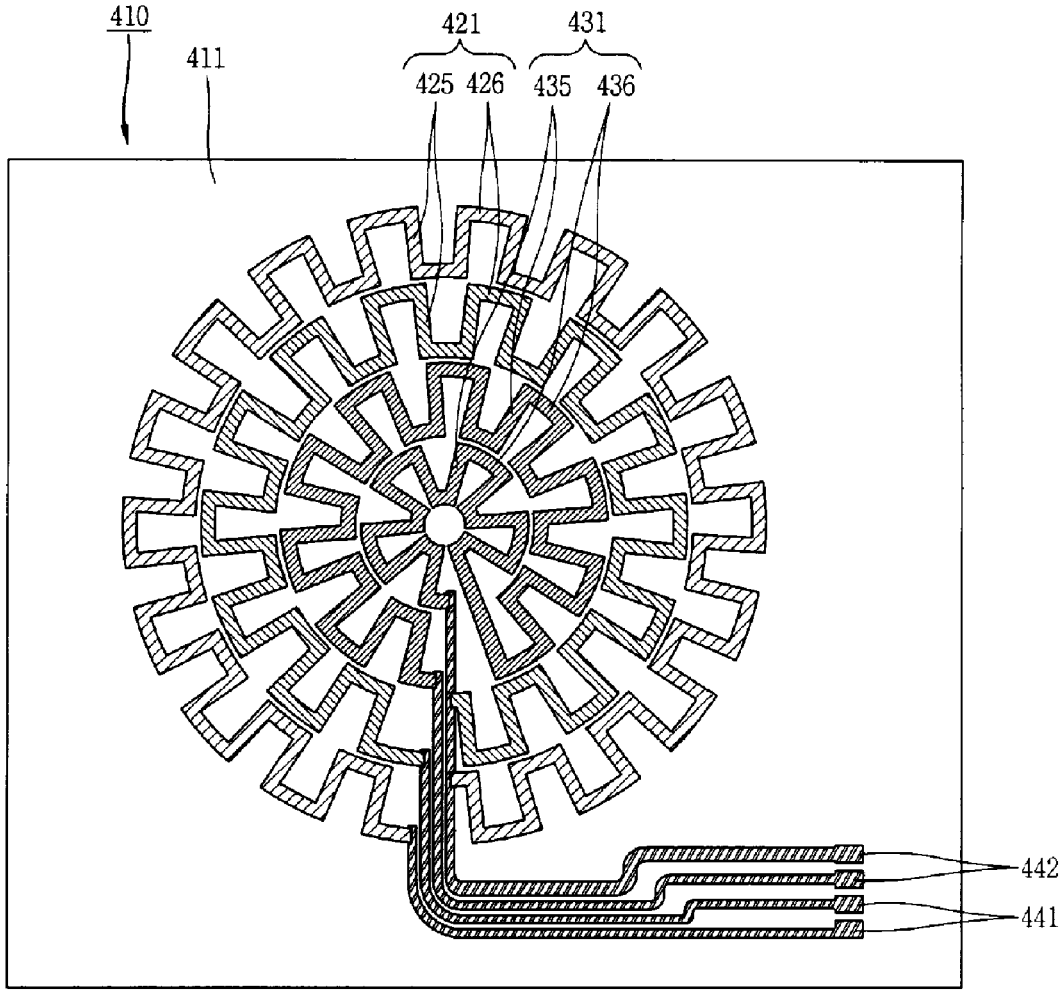

[Fig. 11]
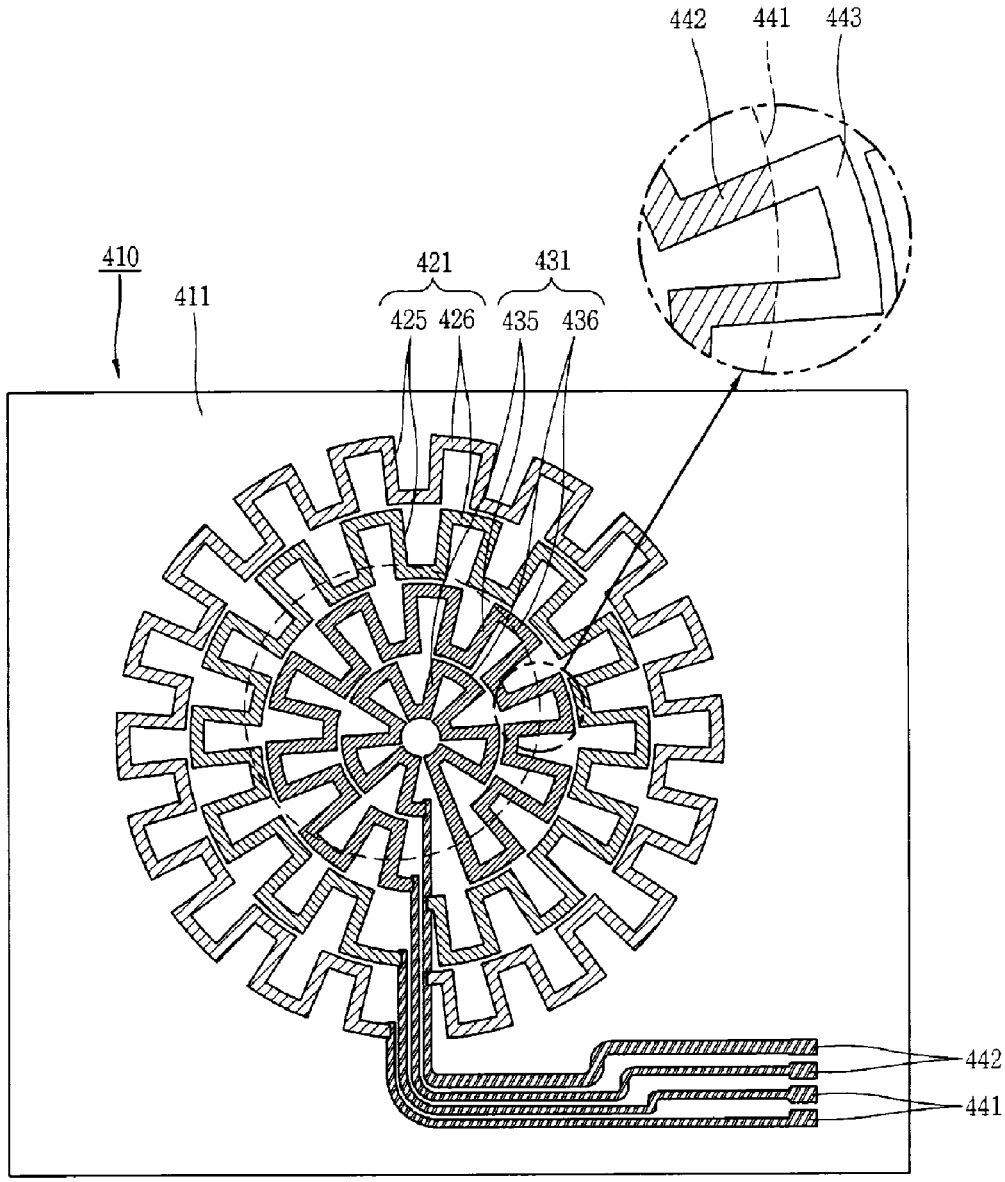

[Fig. 12]
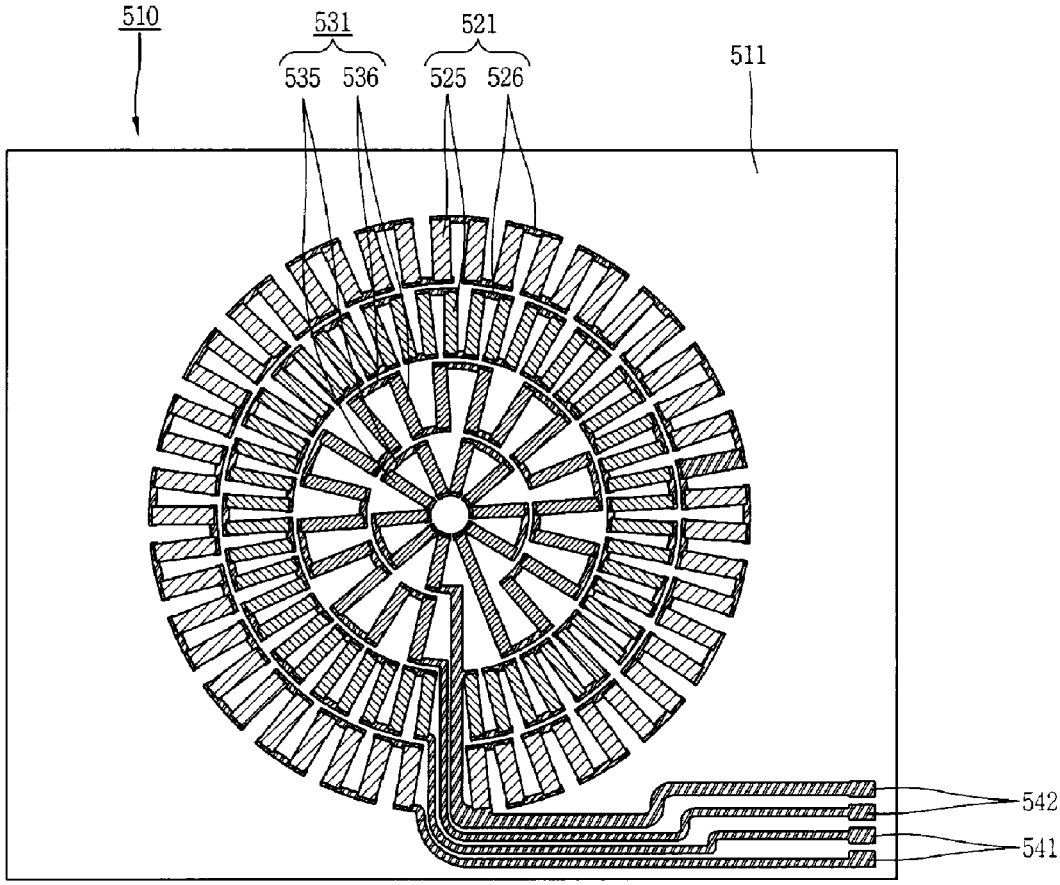

ELECTRIC HEATER

TECHNICAL FIELD

The present invention relates to an electric heater, and more particularly, to an electric heater which is capable of preventing damage to a heating unit.

BACKGROUND ART

In general, an electric heater is a heating apparatus which uses heat generated when a current is conducted through a heating element. Electric heaters are typically manufactured by winding or processing heating wires in a specific shape. For instance, the electric heaters may have a structure, in which heating wires wound onto a mica plate or wound in a certain shape are placed inside a quartz tube, or in which a specific material is filled between heating wires and a stainless tube having a certain distance therebetween after the heating wires are placed in the stainless tube.

The related art electric heater, i.e., the heater using the heating wires, may have a problem of oxidation caused by direct contacting by air when heated as well as a structural problem to support the heating wires.

Considering these problems, a so-called plane heater which is formed by coating a heating element onto a substrate of a ceramic, glass, aluminum, stainless steel, etc. has recently been used. Such a plane heater facilitates a space utilization due to its thinness, and is good for an instantaneous heating due to its short heat transfer path, thereby being increasingly used.

FIG. 1 is an exemplary perspective view of a related art electric heater, and FIG. 2 is an enlarged view showing the main parts of the electric heater in FIG. 1. As shown in the drawings, an electric heater 20 may include a plate-shaped base 21 installed to be exposed on an upper surface of a table or a kitchen counter 10, or the like, a heating unit 31 formed on a surface of the base 21, and a power connection unit 41 for supplying power to the heating unit 31.

The base 21 is made of a glass member and is formed to have a plate shape. Generally, cooking utensils (not shown) are placed on the surface of the base 21, i.e., on an upper surface of the base 21. The heating unit 31 and the power connection unit 41 are disposed at another surface of the base 21, i.e., at a lower surface of the base 21. Indication lines 22 for indicating the positions where the cooking utensils are to be placed and a plurality of manipulation buttons 24 for manipulating the heating unit 31, are provided on the upper surface of the base 21.

Further, the heating unit 31 may include an electric resistor implemented as arc-shaped portions 32 and concentrically spaced from each other in a radial direction from the central portion, and curved portions 33 for connecting the arc-shaped portions 32, thereby forming a consecutively connected curved line shape. The heating unit 31 is connected to the power connection unit 41 so as to be connected to the mains power.

However, in the related art electric heater, when the heating unit 31 is formed in the consecutively curved line shape, a plurality of curved portions 33 having a relatively small curvature (radius of curvature) are formed, which easily leads to a thermal stress concentration therein. Accordingly, cracking, dielectric breakdown, etc. may easily occur at the curved portions 33 or at a periphery of the curved portions 33, compared to at the arc-shaped portions 31 or at a periphery of the arc-shaped portions 31, thus to cause a problem of reducing its service life.

FIG. 3 is an exemplary bottom view showing another related art electric heater. As shown in FIG. 3, an electric heater 50 may include a base 51 disposed to be exposed on an upper surface of a kitchen counter, a table, etc., and a heating unit 61 disposed on a plate surface of the base 51.

The heating unit 61 configured to heat a cooking utensil is formed at another surface of the base 51, i.e., at a lower surface thereof. The heating unit 61 may include arc-shaped portions 63 having an arc shape and concentrically disposed with respect to each other, and connecting portions 65 connecting the arc-shaped portions 63. The heating unit 61 is connected to a power connection unit 71 so as to be connected to the mains power. The heating unit 61, i.e., the arc-shaped portions 63 and the connection portions 65 are implemented as an electric resistor having a large electrical resistance value.

Meanwhile, the cooking utensil may be placed eccentrically, without being aligned onto the center of the heating unit 61. As shown in the dashed line 67 in FIG. 3, if the cooking utensil is placed eccentrically, the heating unit 61 may be divided into two areas comprised of a contact area 68 contacted by the cooking utensil and capable of heat conduction to the cooking utensil, and a non-contact area 69 not contacted by the cooking utensil and thusly incapable of heat conduction to the cooking utensil. Here, the interface formed between the contact area 68 and the non-contact area 69 increases the probability of a thermal/electrical breakdown due to an increase in the temperature gradient.

In the related art electric heater, however, the heating unit 61 is concentrically disposed in a long-and-thin arc shape. Thus, the interface between the contact area 68 and the non-contact area 69 becomes long, thereby increasing the probability of a thermal/electrical breakdown. Accordingly, damage or cracking easily occurs, thus to reduce its life.

In addition, the connection portions 65 connecting the arc-shaped portions 63 are structured to have a relatively small radius of curvature, thereby causing a concentration of the thermal stress (or temperature stress), thus to generate cracking or a dielectric breakdown even at a relatively low power level. Accordingly, there is a limit to enhance the output by more than a certain level.

DISCLOSURE OF INVENTION

Technical Problem

Therefore, it is an object of the present invention to provide an electric heater which can prevent damage to a heating unit.

It is another object of the present invention to provide an electric heater which can prevent damage to a heating unit by controlling a thermal stress concentration and can enhance the output of the electric heater.

It is another object of the present invention to provide an electric heater which can prevent damage to a heating unit due to eccentric placement of a cooking utensil.

Technical Solution

To achieve these and other advantages and in accordance with the purpose of the present invention, as embodied and broadly described herein, there is provided an electric heater, including: a base; and a heating unit having a plurality of unit heating elements disposed on a plate surface of the base, and at least one of heating connection portions configured to heat and conductively connecting the unit heating elements to each other and non-heating connection portions configured not to heat and conductively connecting the unit heating elements to each other.

Further, the unit heating elements may be disposed radially.

In addition, the unit heating elements are connected to a first power connection portion for supplying power.

Also, the unit heating elements may be formed to have a linear or curved line shape.

Also, the heating unit may include a first heating portion, and a second heating portion disposed parallel to one side of the first heating portion.

Also, the heating unit may include a first heating portion, and a second heating portion disposed inside or outside the first heating portion.

Further, the second heating portion may have unit heating elements in a linear or curved line shape.

Further, the unit heating elements of the second heating portion may be connected by heating connection portions configured to heat and for conductively connecting the unit heating elements to each other, or by non-heating connection portions configured not to heat.

Also, the second heating portion may further include a second power connection portion for supplying power.

BRIEF DESCRIPTION OF THE DRAWINGS

In the drawings:

FIG. 1 is a plan view showing an installation of a related art electric heater;

FIG. 2 is an enlarged view showing main parts of the electric heater in FIG. 1;

FIG. 3 is an exemplary bottom view showing another related art electric heater;

FIG. 4 is a bottom view showing an electric heater according to a first embodiment of the present invention;

FIG. 5 is a bottom view showing an electric heater according to a second embodiment of the present invention;

FIG. 6 is a bottom view showing an electric heater according to a third embodiment of the present invention;

FIG. 7 is a bottom view showing an electric heater according to a fourth embodiment of the present invention;

FIG. 8 is a bottom view showing an electric heater according to a fifth embodiment of the present invention;

FIG. 9 is a diagram showing an operation state when a cooking utensil is eccentrically disposed on the electric heater in FIG. 8;

FIG. 10 is a bottom view showing an electric heater according to a sixth embodiment of the present invention;

FIG. 11 is a diagram showing an operation state when a cooking utensil is eccentrically disposed on the electric heater in FIGS. 10; and FIG. 12 is a bottom view showing an electric heater according to a seventh embodiment of the present invention.

MODE FOR THE INVENTION

Reference will now be made in detail to embodiments of the present disclosure, examples of which are illustrated in the accompanying drawings.

Hereinafter, a electric heater according to the present invention will be explained.

FIG. 4 is a bottom view showing an electric heater according to a first embodiment of the present invention. As shown in the drawing, the electric heater 110 may include a base 111, and a heating unit 121 having a plurality of unit heating elements 123 each implemented as an electrical resistor and spaced from each other on a plate surface of the base 111, and non-heating connection portions 125 conductively connecting the unit heating elements 123 to each other.

The base 111 is made of a glass member and is formed to have a rectangular plate shape. Cooking utensils, etc. may be placed on a surface of the base 111, i.e., on an upper surface thereof. The unit heating elements 123 and the non-heating connection portions 125 are formed by a method of coating, etc. at another surface of the base 111, i.e., at a lower surface thereof. Here, the base 111 may be formed of a stainless steel, ceramic, aluminum, or the like. The heating unit 121 is disposed to be insulated with the base 111.

The heating unit 121 is provided with the plurality of unit heating elements 123 in a circular ring shape having one end thereof open and concentrically disposed to each other, and the non-heating connection portions 125 conductively connecting the unit heating elements 123 to each other. Each of the unit heating elements 123 has a uniform width, and is spaced from one another with a certain gap therebetween. This is to uniformly heat over the entire area.

Meanwhile, the non-heating connection portions 125 are formed of a material having a low electrical resistance (e.g., Ag, silver alloy, etc.), compared to the unit heating elements 123. This is to reduce a heating value when powered, compared to the unit heating elements 123, thereby preventing cracking and/or dielectric breakdown due to a temperature increase in the connection area of the heating unit 121 when heated.

A plurality of heating units 121 may be provided so as to control the heating value. Each of the heating units 121 is connected to respective power connection units 127 for supplying power. A control circuit (not shown) for controlling the heating units 121 is respectively connected to the power connection units 127. This is to supply power either separately or simultaneously, by a combination of the power connection units 127, and thus to allow each of the heating units 121 to heat individually or simultaneously, thereby controlling the heating value according to a cooking type or cooked status. It should be noted that the power connection units 127 are not for heating, but for power supply. Accordingly, the power connection units 127 may be formed of the same material as the non-heating connection portions 125.

With this construction, the non-heating connection portions 125 have a small heating value when powered, thereby not causing cracking and dielectric breakdown due to a temperature increase. Based on this, an operation may be stably performed even at a relatively high power level, thereby enhancing the capacity of the electric heater.

FIG. 5 is a bottom view showing an electric heater according to a second embodiment of the present invention. As shown in the drawing, the electric heater 150 according to the present invention may include a base 151, and a heating unit 161 having a plurality of unit heating elements 165 each implemented as an electrical resistor and spaced from each other on a plate surface of the base 151, and non-heating connection portions 167 conductively connecting the unit heating elements 165 to each other. Here, the base 151 is formed of a glass member, and the non-heating connection portions 167 are formed of a material having a low electrical resistance (e.g., Ag, silver alloy, etc.) so as to have a small heating value, compared to the unit heating elements 165 implemented as electrical resistors.

The unit heating elements 165 are each formed to have a bar shape having a certain width and length, and are disposed in parallel. This is to prevent a damage due to a temperature gradient in case a cooking utensil is eccentrically placed with respect to the unit heating elements 165. That is, as shown in the dashed circle 171 in FIG. 5, when a cooking utensil is eccentrically placed, some of the unit heating elements 165 have an interface between a contact area 172 having heat transfer with the cooking utensil and a non-contact area 173 having no heat transfer. Here, the unit heating elements 165 are formed to have a bar shape, thereby reducing the size of the interface and also preventing the occurrence of thermal/electrical damage due to a temperature gradient increase at the interface.

Meanwhile, the heating unit 161 is provided with a first heating portion 162*a* and a second heating portion 162*b* for being separately supplied with power so as to control the heating value. The first heating portion 162*a* and the second heating portion 162*b* are respectively connected to first power connection portions 181 and second power connection portions 183 so as to be connected to the power. Here, the first power connection portions 181 and the second power connection portions 183 may be connected to the power selectively or simultaneously, thereby controlling the heating value.

With this construction, the non-heating connection portions 167 of both the first heating portion 162*a* and the second heating portion 162*b* have a relatively small heating value when powered. Accordingly, the temperature does not increase too high, thus to prevent the occurrence of cracking and dielectric breakdown due to a high temperature. Meanwhile, the first and second heating portions 162*a*, 162*b* may be used to simultaneously heat different cooking utensils or a cooking utensil of a large size. Further, since the unit heating elements 165 of both the first heating portion 162*a* and the second heating portion 162*b* are formed to have a bar shape, in case a cooking utensil is eccentrically placed, damage caused by a temperature increase can be prevented.

FIG. 6 is a bottom view showing an electric heater according to a third embodiment of the present invention. As shown in the drawing, the electric heater 210 according to the present invention may include a base 211, and a heating unit 221 having a plurality of unit heating elements 225, 235 each implemented as an electrical resistor and spaced from each other on a plate surface of the base 211, and non-heating connection portions 227, 237 conductively connecting the unit heating elements 225, 235 to each other.

The heating unit 221 is provided with a first heating portion 222 disposed in a radiating direction, and a second heating portion 232 disposed radially inside of the first heating portion 222. The first heating portion 222 and the second heating portion 232 are respectively connected to first power connection portions 241 and second power connection portions 243 for separately being supplied with power.

Meanwhile, the first heating portion 222 is configured to have a plurality of unit heating elements 225 each having a bar shape and disposed outside the second heating portion 232 so that inner and outer ends thereof can respectively form circular shapes, and non-heating connection portions 227 configured not to heat and conductively connecting the unit heating elements 225 to each other.

The second heating portion 232 is configured to have a plurality of unit heating elements 235 each having a bar shape and disposed parallel so that the outer ends thereof can form a circular shape, and non-heating connection portions 237 configured not to heat and conductively connecting the unit heating elements 235 to each other. Each of the unit heating elements 235 of the second heating portion 232 is formed to have a different length so that outer ends thereof can form a circular shape.

The heating values of the first heating portion 222 and the second heating portion 232 may be appropriately controlled, by selectively connecting power to one of the first power connection portions 241 and the second power connection portions 243, or by simultaneously connecting to the first and second power connection portions 241, 243.

With such configuration, each of the non-heating connection portions 227, 237 of the first and second heating portions 222, 232 does not have a high temperature when powered, thereby not generating cracking and dielectric breakdown as well as performing a stable operation even at a high power level. In addition, cooking utensils of different sizes may be heated by separately using the first and second heating portions 222, 232. When the first and second heating portions 222, 232 are simultaneously used, a cooking utensil of a large size can be quickly heated. Further, each of the unit heating elements 225, 235 of the first and second heating portions 222, 232 has a bar shape, thereby preventing damage caused by a high temperature when cooking utensils are eccentrically positioned.

FIG. 7 is a bottom view showing an electric heater according to a fourth embodiment of the present invention. As shown in the drawing, the electric heater 250 according to the present invention may include a base 251, and a heating unit 261 having a plurality of unit heating elements 265, 275 each implemented as an electrical resistor and spaced from each other on a plate surface of the base 251, and non-heating connection portions 267, 277 conductively connecting the unit heating elements 265, 275 to each other.

The base 251 is made of a glass member, and is formed to have a rectangular plate shape. The unit heating elements 265, 275 and the non-heating connection portions 267, 277 are disposed at a lower surface of the base 251.

The heating unit 261 is provided with, according to its position, a first heating portion 262, and a second heating portion 272 disposed inside with respect to the first heating portion 262.

The first heating portion 262 is provided with a plurality of unit heating elements 265 disposed outside of the second heating portion 272 in a radial shape, and non-heating connection portions 267 configured not to heat and conductively connecting the unit heating elements 265 to each other.

The second heating portion 272 is provided with a plurality of unit heating elements 275 having an arc-shape and concentrically disposed with respect to each other, and non-heating connection portions 267 configured not to heat and conductively connecting the unit heating elements 275 to each other.

The first and second heating portions 262, 272 are respectively connected to first power connection portions 281 and second power connection portions 283 so as to be connected to power. A control circuit (not shown) for selectively supplying power is respectively connected to the first and second heating portions 262, 272.

With such configuration, the first and second heating portions 262, 272 are prevented from a temperature increase by the non-heating connection portions 267, 277, thereby preventing the occurrence of cracking and dielectric breakdown. In addition, when a cooking utensil is eccentrically positioned, the unit heating elements 265 of the first heating portion 262 have a relatively small non-contact area, which has no heat transfer with the cooking utensil. Thus, thermal/electrical damage due to a high temperature can be prevented.

FIG. 8 is a bottom view showing an electric heater according to a fifth embodiment of the present invention. FIG. 9 is a diagram showing an operation state when a cooking utensil is disposed eccentrically on the electric heater in FIG. 8. As shown in the drawings, the electric heater 310 according to the present invention may include a base 311, a plurality of unit heating elements 325, 335 each implemented as an electrical resistor and radially disposed on the base 311, and first and second power connection portions 371, 372 for supplying power to the unit heating elements 325, 335.

The base 311 is made of a glass member, and is formed to have a rectangular plate shape. Cooking utensils may be placed on an upper surface of the base 311.

Further, a heating unit 320 is disposed at a lower surface of the base 311 so as to heat the cooking utensils when power is supplied. The heating unit 320 includes a first heating portion 321 disposed in a radiating direction, and a second heating portion 351 disposed radially inside with respect to the first heating portion 321.

The first heating portion 321 is configured to have an outer heating section 322 disposed in a radiating direction, and an inner heating section 332 disposed radially inside of the outer heating section 322. The outer heating section 322 is provided with a plurality of unit heating elements 325 each formed to have a bar or rectangular plate shape and disposed radially, and heating connection portions 326 conductively connecting the unit heating elements 325 to each other and configured to heat when conducted. The unit heating elements 325 are each implemented as a heating element having a large electrical resistance value and are spaced from each other in a circumferential direction with a certain width and interval. The heating connection portions 326 may be integrally formed by using the same material as the unit heating elements 325 so as to heat when powered.

The inner heating section 332 is provided with a plurality of unit heating elements 335 each having a bar or rectangular plate shape and radially disposed, and heating connection portions 336 conductively connecting the unit heating elements 335 to each other and being configured to heat when powered.

The second heating portion 351 is provided with a plurality of unit heating elements 355 each having an arc shape and spaced from each other in a radial direction, and heating connection portions 356 connecting the unit heating elements 355.

Further, the first and second heating portions 321, 351 are respectively connected to first power connection portions 371 and second power connection portions 373 so as to be connected to power. A control circuit (not shown) is respectively connected to the first and second power connection portions 371, 373. The control circuit may be configured to control a heating value by allowing the first and second heating portions 321, 351 to heat simultaneously or according to its connected state.

With such construction, when cooking utensil is eccentrically placed on an upper surface of the base 311, as shown in the dashed line 341 in FIG. 9, the unit heating elements 325, 335 of the first heating portion 321 are radially disposed. Accordingly, only a very short interface is formed between a contact area 342 of the unit heating elements 325 contacting the cooking utensil and a non-contact area 343, thereby preventing the occurrence of cracking and dielectric breakdown, by reducing the probability of a localized hot spot.

FIG. 10 is a bottom view showing an electric heater according to a sixth embodiment of the present invention. FIG. 11 is a diagram showing an operation state when a cooking utensil is disposed eccentrically on the electric heater in FIG. 10. As shown in the drawings, the electric heater 410 according to the present invention may include a base 411, and first and second heating units 421, 431 spaced from each other in a radial direction on a plate surface of the base 411. And, the first and second heating units 421, 431 are provided with unit heating elements 425, 435 disposed radially, and connection portions 426, 436 conductively connecting the unit heating elements 425, 435 to each other.

The unit heating elements 425, 435 are each implemented as a heating element, and the connection portions 426, 436, as a heating element, are integrally formed with the unit heating elements 425, 435, thereby heating when powered.

With such construction, when a cooking utensil is placed eccentrically on an upper surface of the base 411, the unit heating elements 425 have a relatively small interface between an area contacting a bottom of the cooking utensil and a non-contact area, thereby having a small temperature increase and preventing damage due to a temperature increase. In addition, when the second heating unit 431 is used to heat a relatively small-sized cooking utensil, as shown in the dashed line 441 in FIG. 11, even though the cooking utensil is placed eccentrically, the unit heating elements 435 of the second heating unit 431 are radially disposed. Accordingly, the interface between a contact area 442 contacting the cooking utensil and a non-contact area 443 not contacting the cooking utensil becomes small, thereby preventing damage due to a temperature increase.

FIG. 12 is a bottom view showing an electric heater according to a seventh embodiment of the present invention. As shown in the drawing, the electric heater 510 according to the present invention may include a base 511, and first and second heating units 521, 531 spaced from each other in a radial direction on a plate surface of the base 511. And, the first and second heating units 521, 531 are provided with radially disposed unit heating elements 525, 535, and non-heating connection portions 526, 536 conductively connecting the unit heating elements 525, 535 to each other.

The unit heating elements 525, 535 are each implemented as a heating element, and the non-heating connection portions 526, 536 are formed of a material having a small heating value (e.g., Ag, silver alloy, etc.) compared to the heating elements, not so as to generate heat when powered.

With such configuration, when a cooking utensil is disposed eccentrically on the upper surface of the base 511, the unit heating elements 525 of the first heating portion 521, being radially disposed, thereby form only a small interface between a contact area contacting with the cooking utensil and a non-contact area. Accordingly, the temperature does not increase too high, and damage due to a temperature increase can be prevented.

Also, when the second heating portion 531 is used for a small-sized cooking utensil, even if the cooking utensil is disposed eccentrically, the unit heating elements 535 of the second heating portion 531, being radially disposed, thereby form a small interface between a contact area 542 contacting with the cooking utensil and a non-contact area 543, thus to prevent damage due to a temperature increase.

In addition, the non-heating connection portions 526, 536 connecting the unit heating elements 525, 535 of the first and second heating portions 521, 531 generate less heat when powered. Therefore, even though a thermal stress concentration is focused thereat, the temperature is not too high, thereby not generating cracking and/or dielectric breakdown, thus to stably operate even at a relatively high level power.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

Industrial Applicability

The electric heater according to the present invention may be used for cooking utensils such as an electric rice-cooker, an electric kettle as well as for so-called "cook-tops" disposed on a kitchen counter and/or a table of a kitchen.

The electric heater according to the present invention may be used for electric appliances such as an electric iron, a dish washer, a drum washing machine and/or a heating mat, beauty aid as well as an industrial electric heater.

The invention claimed is:

1. An electric heater, comprising:

a base; and a heating unit having a plurality of unit heating elements disposed on a plate surface of the base, and at least one of heating connection portions configured to heat and conductively connecting the unit heating elements to each other and non-heating connection portions configured not to heat and conductively connecting the unit heating elements to each other.

2. The electric heater of claim 1, wherein the unit heating elements are connected by the non-heating connection portions.

3. The electric heater of claim 1, wherein the unit heating elements are formed to have a uniform width.

4. The electric heater of claim 1, wherein the unit heating elements are spaced from each other by a predetermined interval.

5. The electric heater of claim 1, further comprising:

a first power connection portion for supplying power to the unit heating elements.

6. The electric heater of claim 1, wherein the heating unit includes a first heating portion, and a second heating portion disposed at one side of the first heating portion.

7. The electric heater of claim 6, further comprising:

first and second power connection portions for respectively supplying power to the first and second heating portions.

8. The electric heater of claim 1, wherein the unit heating elements are formed in a linear shape, and are connected by the non-heating connection portions.

9. The electric heater of claim 1, wherein the unit heating elements are formed in a curved line shape, and are connected by the non-heating connection portions.

10. The electric heater of claim 1, wherein the unit heating elements are disposed such that outer ends thereof form a tetragonal shape.

11. The electric heater of claim 1, wherein the unit heating elements are disposed radially.

12. The electric heater of claim 1, wherein the unit heating elements are disposed such that outer ends thereof form a circular shape.

13. The electric heater of claim 12, wherein the heating unit includes a first heating portion of which inner and outer ends thereof form circular shapes, and a second heating portion disposed radially inside of the first heating portion.

14. The electric heater of claim 13, wherein the second heating portion is provided with a plurality of unit heating elements disposed in a linear or curved line shape.

15. The electric heater of claim 14, wherein the unit heating elements of the second heating portion are formed in a bat shape, and disposed radially.

16. The electric heater of claim 15, wherein the unit heating elements of the second heating portion are connected by the non-heating connection portions configured not to heat and conductively connecting the unit heating elements to each other.

17. The electric heater of claim 14, wherein the second heating portion is provided with a plurality of unit heating elements formed to have a bar shape and disposed such that outer ends thereof form a circular shape.

18. The electric heater of claim 14, wherein the second heating portion is provided with a plurality of unit heating elements having an arc shape and disposed concentrically to each other.

19. The electric heater of claim 1, wherein the heating unit includes a first heating portion having unit heating elements disposed concentrically to each other in an arc shape and connected by the non-heating connection portions, and a second heating portion having a plurality of unit heating elements disposed inside the first heating portion and disposed concentrically to each other, and non-heating connection portions configured not to heat and conductively connecting the unit heating elements to each other.

* * * * *